US010288353B2

(12) United States Patent
Strecker et al.

(10) Patent No.: US 10,288,353 B2
(45) Date of Patent: May 14, 2019

(54) HEAT EXCHANGER

(71) Applicant: WEBASTO SE, Stockdorf (DE)

(72) Inventors: Uwe Strecker, Inning (DE); Volodymyr Ilchenko, Gilching (DE); Klaus Appel, Moskau (RU)

(73) Assignee: WEBASTO SE, Stockdorf (DE)

( * ) Notice: Subject to any disclaimer, the term of this patent is extended or adjusted under 35 U.S.C. 154(b) by 108 days.

(21) Appl. No.: 14/770,642

(22) PCT Filed: Feb. 17, 2014

(86) PCT No.: PCT/EP2014/053018

§ 371 (c)(1),
(2) Date: Aug. 26, 2015

(87) PCT Pub. No.: WO2014/131642

PCT Pub. Date: Sep. 4, 2014

(65) Prior Publication Data

US 2016/0363379 A1 Dec. 15, 2016

(30) Foreign Application Priority Data

Feb. 28, 2013 (DE) ..... 10 2013 003 414

(51) Int. Cl.
*B60H 1/00* (2006.01)
*F28D 7/12* (2006.01)
(Continued)

(52) U.S. Cl.
CPC ..... *F28D 7/12* (2013.01); *F28D 7/103* (2013.01); *F28F 13/06* (2013.01); *F28D 2021/008* (2013.01); *F28F 2250/102* (2013.01)

(58) Field of Classification Search
CPC ... F28D 7/10; F28D 7/12; F28D 7/103; F28D 2021/008; F28D 7/16; F28F 13/06;
(Continued)

(56) References Cited

U.S. PATENT DOCUMENTS 5,542,467 A 8/1996 Carpentier
6,170,568 B1 * 1/2001 Valenzuela ..... F28D 9/0012 165/166
(Continued)

FOREIGN PATENT DOCUMENTS

CN 101581546 A 11/2009
DE 101 43 479 C1 1/2003
(Continued)

OTHER PUBLICATIONS

International Search Report dated Jun. 26, 2014 in connection with PCT/EP2014/053018.

*Primary Examiner* — Keith Raymond
*Assistant Examiner* — Kamran Tavakoldavani
(74) *Attorney, Agent, or Firm* — Quarles & Brady LLP

(57) ABSTRACT

The invention relates to a heat exchanger, preferably for motor vehicles, comprising a heat exchanger body (11), a first fluid channel (18), which is flowed through by a first fluid (12), and a second fluid channel (36), which is flowed through by a second fluid (14), wherein one of the fluids, either the first fluid (12) or the second fluid (14) is warmer than the other of the fluids, the first fluid (12) or the second fluid (14), wherein, after entering a heat exchanging region, a heat transfer (30) from the warmer fluid (14) to the colder fluid (12) takes place in the heat exchanging region, wherein the first channel (18) and the second fluid channel (36) have in the heat exchanging region at least two shared co-current regions (25) and a shared counter-current region (27) arranged between the co-current regions (25), or have at least two shared counter-current regions (27) and a shared co-current region (25, 125, 225) arranged between the counter-current regions (27).

14 Claims, 6 Drawing Sheets

Figure 1A:
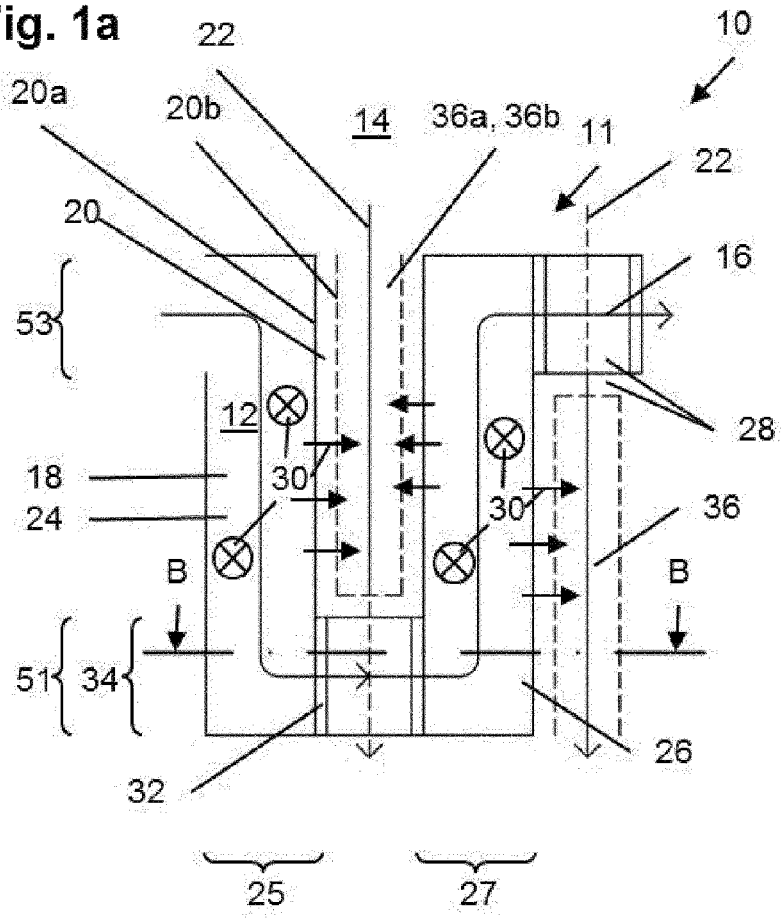

(51) Int. Cl.

| | |
|---|---|
| ***F28D 7/10*** | (2006.01) |
| ***F28F 13/06*** | (2006.01) |
| *F28D 21/00* | (2006.01) |

(58) Field of Classification Search
CPC .... F28F 2250/102; F28F 9/22; F28F 2250/10; F28F 2250/04
See application file for complete search history.

(56) References Cited

U.S. PATENT DOCUMENTS

| | | | | |
|---|---|---|---|---|
| 2010/0025023 | A1* | 2/2010 | Schmidt | F28D 7/0066 165/157 |
| 2012/0234021 | A1* | 9/2012 | Okuda | F25B 21/02 62/3.2 |
| 2013/0146263 | A1* | 6/2013 | Kim | F28D 7/0041 165/155 |
| 2016/0363379 | A1 | 12/2016 | Strecker et al. | |

FOREIGN PATENT DOCUMENTS

| | | | |
|---|---|---|---|
| DE | 10223788 | C1 | 6/2003 |
| DE | 10210734 | A1 | 10/2003 |
| DE | 10 2004 008358 | A1 | 9/2005 |
| DE | 10 2005 006055 | A1 | 8/2006 |
| DE | 102008025314 | A1 | 12/2009 |
| DE | 102010040278 | A1 | 3/2012 |
| DE | 102011118164 | A1 | 7/2012 |
| DE | 102011007784 | A1 | 10/2012 |
| DE | 102012209431 | A1 | 1/2013 |

* cited by examiner

HEAT EXCHANGER

CROSS-REFERENCE TO RELATED APPLICATIONS

This application represents the national stage entry of PCT International Application No. PCT/EP2014/053018 filed Feb. 17, 2014, which claims the benefit of German Patent Application 10 2013 003 414.0 filed Feb. 28, 2013, both of which are hereby incorporated herein by reference for all purposes.

The invention relates to a heat exchanger, in particular cylindrical heat exchanger, preferably for motor vehicles.

Cylindrical heat exchangers are known for example from DE 102 23 788 C1. Tubes which conduct a first fluid extend in a longitudinal direction through the cylindrical heat exchanger along its longitudinal axis and in an outer region. A second fluid is conducted in an inner region of the heat exchanger. A return flow of the second fluid takes place in the outer region in a cavity surrounding the tubes. In this case, in the surrounding cavity, the second fluid is conducted in each case by fluid-guiding walls perpendicular to the tubes, wherein an exchange of heat takes place in accordance with the counterdirectional-flow principle in alternation with the cross-flow principle.

Purely codirectional-flow systems are generally distinguished by relatively poor heat exchange performance. In the case of purely counterdirectional-flow arrangements, layers form which impair the heat transfer.

It is an object of the invention to specify a heat exchanger which permits an efficient exchange of heat from a first fluid to a second fluid.

Said object is achieved by a heat exchanger having the features of claim 1.

A heat exchanger having a heat exchanger body, preferably for a motor vehicle, comprising a first fluid duct through which a first fluid flows and a second fluid duct through which a second fluid flows. One out of the first fluid and the second fluid is warmer than the other out of the first fluid and the second fluid, wherein, after said fluids enter a heat exchange region of the heat exchanger, an exchange of heat from the relatively warm fluid to the relatively cool fluid takes place in the heat exchange region. Here, the first fluid duct and the second fluid duct have, in the heat exchange region, at least two common codirectional-flow regions and one common counterdirectional-flow region arranged between the codirectional-flow regions, or at least two common counterdirectional-flow regions and one common codirectional-flow region arranged between the counterdirectional-flow regions. Through the provision, in this way, of alternating counterdirectional-flow regions and codirectional-flow regions, an efficient exchange of heat from the first fluid to the second fluid or vice versa is advantageously realized. The heat exchange region is in this case the entire region of the heat exchanger in which heat is exchanged in a technically meaningful manner from the first fluid to the second fluid; it is in particular the region in which the first fluid duct and the second fluid duct have a common wall. A total heat transition coefficient is higher in the case of the mixed arrangement of alternating codirectional-flow regions and counterdirectional-flow regions than in the case of an arrangement of the fluid ducts relative to one another which operates only on the basis of the codirectional-flow principle or only on the basis of the counterdirectional-flow principle. The heat exchanger body may in particular be of cylindrical or plate-shaped form, wherein, in the case of a cylindrical form, one of the two fluids is conducted in an interior of the cylinder and the other of the two fluids is conducted in an outer region of the cylinder. The heat exchanger body may however also be of conical form. If the heat exchanger is of plate-shaped form, the first fluid flows on one side of the plate and the second fluid flows on the other side of the plate. To realize a changeover between one of the counterdirectional-flow regions and one of the codirectional-flow regions, at least one of the fluids is diverted in a changeover region. The changeover region may be arranged within or outside the heat exchange region. If the changeover region is arranged in the heat exchange region, then an exchange of heat on the basis of the cross-flow principle, an exchange of heat in a cross-flow arrangement, takes place at the same time. Furthermore, a compact design is advantageously realized in this way, as a larger heat exchange region can be realized by way of the windings. It may be provided that the first fluid is a liquid, in particular a coolant, preferably water or a water-glycol mixture, and that the second fluid is a gas, preferably an exhaust gas or air. It may however also be provided that the first fluid is a gas and the second fluid is a liquid. The first fluid is preferably a hot exhaust gas or combustion air from a combustion chamber. It may furthermore be provided that both fluids are liquid or both fluids are gaseous. It is self-evident that the heat exchanger described here may be surrounded by a housing and has at least one first fluid inflow and at least one second fluid inflow and at least one first fluid outflow and one second fluid outflow. It may be provided that the first fluid flows into the first fluid duct through the first fluid inflow and that the first fluid flows out of the first fluid duct through the first fluid outflow. It may be provided that the second fluid flows into the second fluid duct through the second fluid inflow and that the second fluid flows out of the second fluid duct through the second fluid outflow. It may be the case that a multiplicity of first fluid ducts and/or second fluid ducts are provided.

It may be provided that a fluid partition is arranged between the first fluid duct and the second fluid duct, wherein the fluid partition preferably has a constant wall thickness, in particular a constant wall thickness in the heat exchange region. In this case, a manufacturing-induced thickness fluctuation of up to 15% of the wall thickness is also defined as being constant; this however cannot be said of a designed, that is to say intentional thickness fluctuation or thickness variation over the profile of the fluid partition. It is preferably the case that only a manufacturing-induced thickness fluctuation of up to 10% of the wall thickness is regarded as being constant. By means of the constant wall thickness, a situation is advantageously prevented in which material accumulations in the fluid partition lead to discontinuities in the heat conductivity of the fluid partition. Furthermore, this advantageously facilitates production of the heat exchanger. Further advantages of a constant wall thickness are reduced formation of shrink holes, reduced material stresses and thus increased service life of the heat exchanger. The heat exchanger is preferably produced from aluminum or an aluminum alloy; the heat exchanger may however also be produced from other materials which are suitable for the exchange of heat, for example copper or iron or the alloys thereof. In particular, the heat exchanger is a cast part, wherein the heat exchanger is preferably produced by continuous casting. Owing to the constant wall thickness, cooling of the heat exchanger during the production process takes place more quickly and more uniformly. In this way, a production duration can advantageously be reduced.

It may be provided that the first fluid flows in succession through a first of the at least two codirectional-flow regions, a first counterdirectional-flow region and a second of the at least two codirectional-flow regions. It may be provided that the first fluid flows in succession through a first of the at least two counterdirectional-flow regions, a first codirectional-flow region and a second of the at least two counterdirectional-flow regions. It may also be provided that the first fluid flows through further codirectional-flow regions and counterdirectional-flow regions in an alternating sequence. In particular, it may be provided that the first fluid is split into a first partial fluid flow and a second partial fluid flow, wherein the first partial fluid flow and the second partial fluid flow are each conducted in alternation through codirectional-flow regions and counterdirectional-flow regions. It is advantageously achieved in this way that an exchange of heat from the first fluid to the second fluid is increased. It is particularly advantageously the case that the first fluid flows, in each partial flow region, through in each case four counterdirectional-flow regions and three codirectional-flow regions before the two partial flows of the first fluid are merged again and supplied to an outlet. It is self-evident that other numbers of codirectional-flow regions and counterdirectional-flow regions may also be provided. In particular, it is possible for 8, 10, 12, 14 or 16 counter flow regions and a corresponding number of codirectional-flow regions to be arranged in alternation with one another, wherein the regions lined up together in alternating fashion preferably collectively form a shell surface of a cylinder.

It may be provided that the counterdirectional-flow regions and the codirectional-flow regions are arranged between a base region and a top region of the heat exchanger body. In this case, it may be provided that the counterdirectional-flow sections and the codirectional-flow sections run perpendicular to the base region and/or to the top region.

It may be provided that a changeover region between a counterdirectional-flow region and a codirectional-flow region is arranged in the base region and/or in the roof region.

It may advantageously be provided that an inlet and an outlet for the first fluid are arranged together in a base region or in the top region. In this way, an installation space for attachment tube lines can advantageously be reduced.

It may be provided that an inlet and an outlet for the second fluid are arranged together in the base region or in the top region.

It may be provided that the inlet and the outlet for the second fluid have a common opening.

It may be provided that the first fluid duct has a first contour in the counterdirectional-flow region and has a second contour in the codirectional-flow region, wherein the first contour and the second contour are preferably arranged in the heat exchange region. A contour is to be understood to mean the internal wall, which imparts a direction to the first fluid, of the first fluid duct; in particular, the contour is to be understood to mean the cross-sectional area, through which flow passes, of the first fluid duct. It may advantageously be provided that the first contour and the second contour have a mutually parallel profile in the heat exchange region, such that the flow direction of the first fluid in the codirectional-flow arrangement and the flow direction of the first fluid in the counterdirectional-flow arrangement run oppositely but in parallel. The first contour and/or the second contour may have a square, rectangular, triangular, trapezoidal, circular or elliptical cross section or any desired combination of these cross sections. It may be provided that the first fluid duct and/or the second fluid duct have/has a coiled profile, wherein it may be provided that the coiled profile has at least one curvature or one edge. It is self-evident that the second fluid duct also or alternatively has contours, to which the above statements apply correspondingly.

It may advantageously be provided that the first fluid duct has at least one counterdirectional-flow duct section and at least one codirectional-flow duct section, wherein the counterdirectional-flow section is defined as being that section of the first fluid duct in which the first fluid flows in an opposite direction to the second fluid, and wherein the codirectional-flow section is defined as that section of the first fluid duct in which the first fluid flows in the same direction as the second fluid. It may also be provided that the counterdirectional-flow duct section and the codirectional-flow duct section are fluidically connected.

It may also be provided that a flow partition is arranged between two adjacent duct sections—a counterdirectional-flow duct section and a codirectional-flow duct section, wherein the flow partition is preferably a duct rib. In this way, it is advantageously possible to realize an exchange of heat between the first fluid and the second fluid or between the first fluid in the counterdirectional-flow duct section and the first fluid in the codirectional-flow duct section. Furthermore, simple modeling of the exchange of heat from the first fluid to the second fluid or from the first fluid in the counterdirectional-flow duct section and the first fluid in the codirectional-flow duct section is advantageously possible in this way. The flow partition may be of solid or hollow form. It may be provided that the flow partition exhibits high heat conductivity, wherein the heat conductivity is preferably higher than the heat conductivity of pure iron, preferably of brass, particularly preferably of pure aluminum, such that heat equalization between the first fluid in the codirectional-flow duct section and the first fluid in the counterdirectional-flow duct section or between the first fluid and the second fluid is advantageously possible. It may also be provided that the flow partition exhibits low heat conductivity, which is preferably lower than the heat conductivity of pure iron, such that as little heat as possible is transferred from the first fluid in the counterdirectional-flow duct section to the second fluid in the codirectional-flow duct section or vice versa.

It may advantageously be provided that the second fluid duct is arranged at least partially in the flow partition. In this way, an intensive exchange of heat from the second fluid to the first fluid or vice versa is advantageously realized. It may also be provided that the second fluid duct is arranged only in every second or third flow partition, or at least partially less frequently.

It may be provided that the flow partition has a constant wall thickness, such that material accumulations and thus discontinuous profiles of heat conductivity in the flow partition are avoided. In this way, the heat conductivity of the heat exchanger is altogether advantageously increased.

It may also be provided that a fluid partition arranged between the first fluid duct and the second fluid duct is provided, wherein the fluid partition advantageously has a cylindrical basic shape, and wherein the flow partition forms a part of the fluid partition. The fluid partition is advantageously a part of the heat exchanger body, wherein the third partition is preferably arranged between a base region and a top region of the heat exchanger body. In this way, it is advantageously possible for the heat exchanger to be of compact form. Furthermore, it is advantageously possible in this way to realize cheaper production, wherein, for example, the heat exchanger can be manufactured in one piece by deep drawing. It is self-evident that the heat exchanger may be of unipartite form. In particular, it is possible in this way to eliminate mountable guide structures and thus connecting means, which are disadvantageous from a heat aspect, for connecting the mounted guide structures to the heat exchanger.

It may preferably be provided that the flow partition is an outwardly pointing part of the partition. Alternatively, it may be provided that the flow partition is an inwardly pointing part of the partition. The flow partition may preferably have a rounded or angular form.

It may particularly advantageously be provided that overflow edges are arranged in the first fluid duct such that swirl is imparted to the first fluid in the first fluid duct. This way, a greater exchange of heat is realized through the elimination of fluid layers. The overflow edges may be elongations of the flow partitions, wherein the overflow edges take up only a part of the cross section of the first fluid ducts. In this way, particularly simple production of the heat exchanger is realized.

It may be provided in particular that the overflow edges are arranged in a changeover region between a counterdirectional-flow region and a codirectional-flow region. It may however additionally or alternatively be provided that the overflow edges are arranged in the counterdirectional-flow regions or in the codirectional-flow regions. It may also be provided that the overflow edges are provided only in the changeover region. Owing to the arrangement in the changeover region, mixing of cold and warm layers of the first fluid is particularly advantageously realized in the changeover region, wherein an exchange of heat between the first fluid and a wall of the first fluid duct can thus be improved, wherein it is advantageously the case that, in the relatively long codirectional-flow duct sections and counterdirectional-flow duct sections which preferably form the counterdirectional-flow arrangement and codirectional-flow arrangement, a laminar flow or layered flow can arise such that advantageously low friction losses in the fluid can be realized, and a higher flow speed can be attained.

It is self-evident that the statements made regarding the first fluid duct can like-wise be applied to the second fluid duct without departing from the scope of the invention.

FIG. 1*a* shows a schematic view of a first exemplary embodiment of a heat exchanger.

Figure 1B:
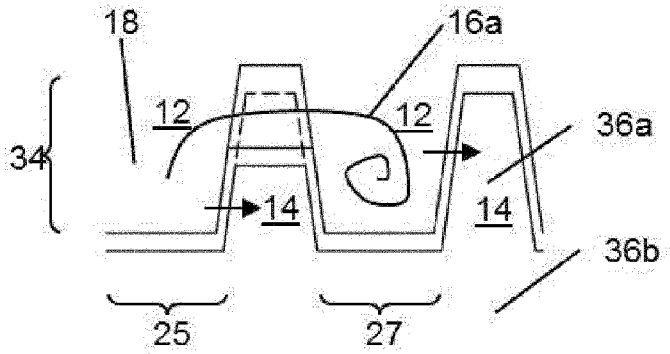

FIG. 1*b* shows a sectional view of the first exemplary embodiment along the line B-B.

Figure 1C:
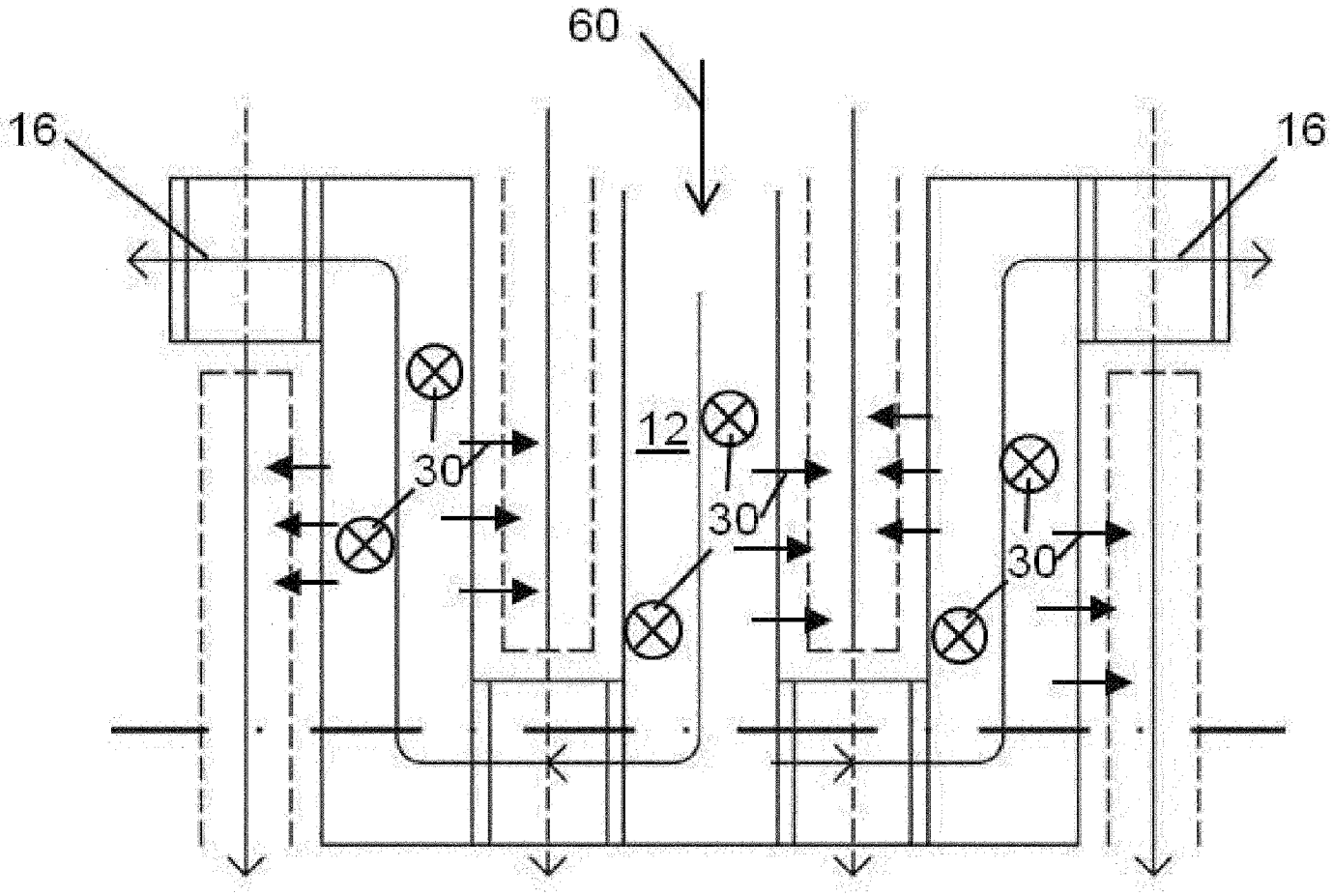

FIG. 1*c* shows a schematic view of a modification of the first exemplary embodiment.

Figure 2A:
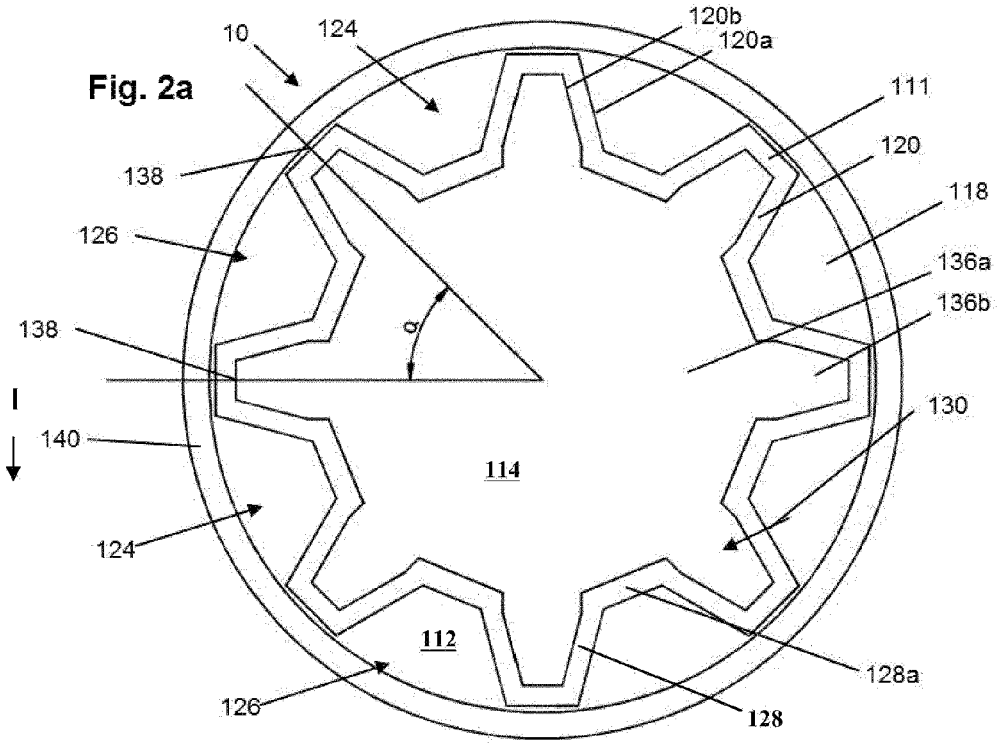

FIG. 2*a* shows a plan view of a second exemplary embodiment of a heat exchanger having a multiplicity of wall sections as per FIGS. 1*a* and 1*b* in a cylindrical arrangement.

Figure 2B:
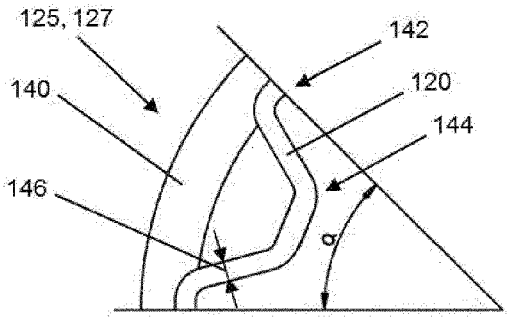

FIG. 2*b* shows an angular segment of the second exemplary embodiment from FIG. 2*a*.

Figure 3A:
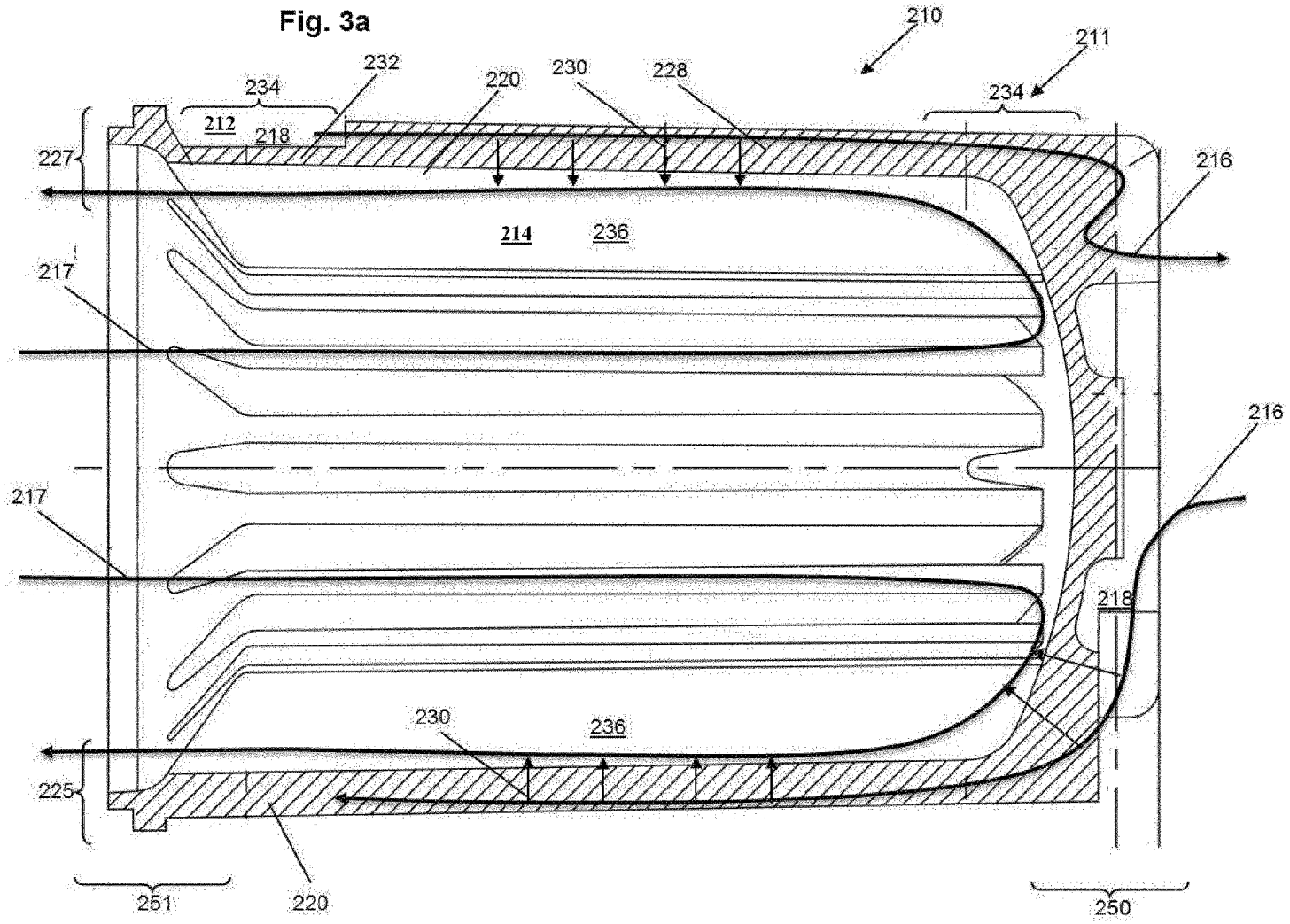

FIG. 3*a* shows an internal view of a heat exchanger body of a third exemplary embodiment of a heat exchanger.

Figure 3B:
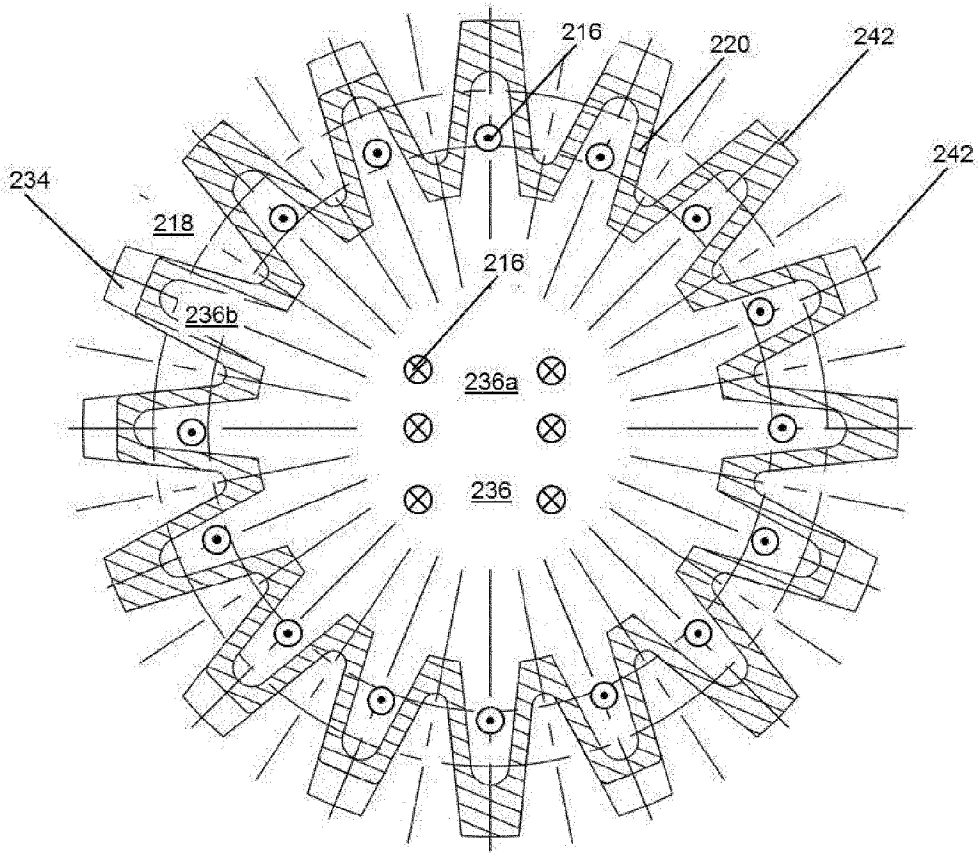

FIG. 3*b* shows a sectional view through the fluid partition of the third exemplary embodiment of the heat exchanger.

Figure 3C:
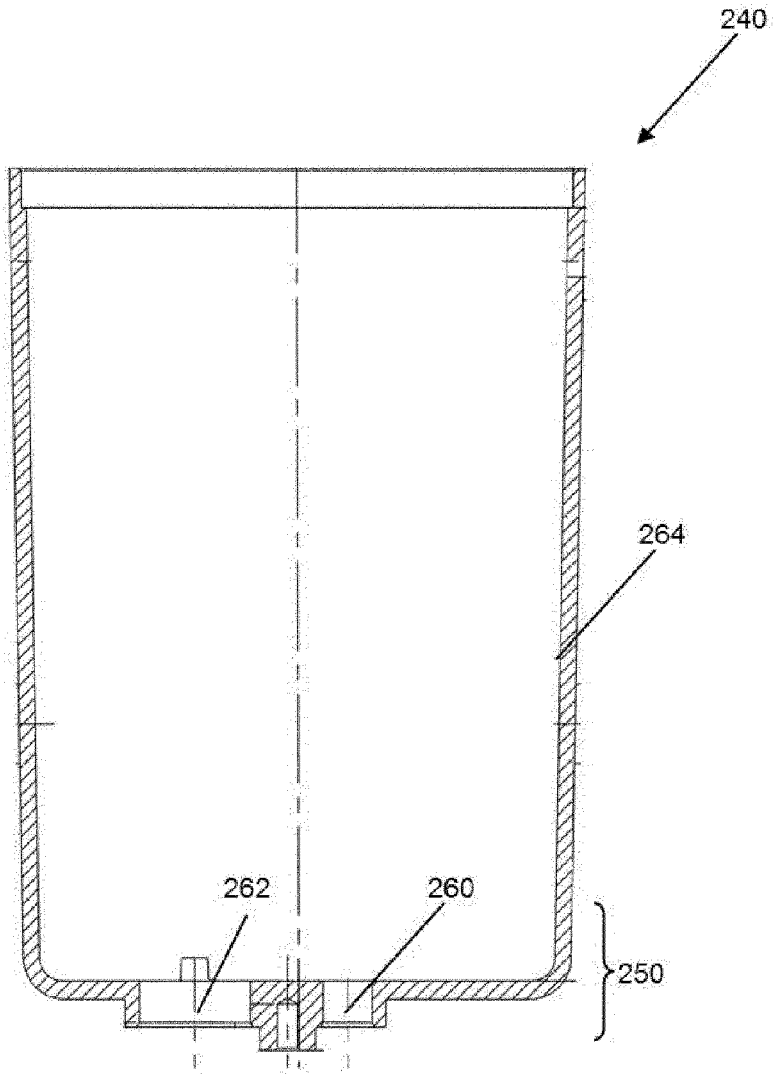

FIG. 3*c* shows a housing of the heat exchanger of the third exemplary embodiment.

In the following description of the drawings, the same reference signs are used to denote identical or similar components. It is self-evident that the designations such as top, bottom, left, right and the like are always to be read in relation to the present figures, and other directions and locations are possible by way of rotation and mirroring of the exemplary embodiments shown.

FIG. 1*a* shows, in a schematic illustration, a first exemplary embodiment of a heat exchanger 10 according to the invention, wherein a first arrangement of a flow profile section of a first fluid 12 and of a second fluid 14 on a heat exchanger body 11 is shown. The exemplary embodiment shown in FIG. 1*a* may be regarded in particular as a schematic side view of a repeating wall section of a heat exchanger body 11, wherein the wall section may be a part of a curved outer wall of the preferably cylindrical heat exchanger body 11. The illustrated wall section may however also be a non-curved intermediate wall of two planar flow ducts of the heat exchanger which run parallel to one another and which bear against one another. In particular, FIG. 1*a* shows a continuous heat exchange region of the exemplary embodiment, wherein FIG. 1*a* shows a codirectional-flow region 25 and a counterdirectional-flow region 27 which are fluidically connected via a changeover region 34 in which the first fluid performs a change in direction through a total of 180° in the present case.

FIG. 1*b* shows a sectional view of the heat exchanger illustrated in FIG. 1*a* along the line B-B.

The first fluid 12 flows along a first flow path 16 in a first fluid duct 18 and, in the process, follows a contour, running around flow partitions 20, of the first fluid duct 18. The first flow path 16 corresponds to an average profile of the flow lines of the first fluid 12 through the first fluid duct 18. It is self-evident that at least two flow partitions 20 or a multiplicity of flow partitions 20 may be arranged in the first fluid duct 18. In particular, a multiplicity of flow profile sections of the first fluid 12 as shown in FIG. 1*a* may be lined up in series. It is self-evident that the first fluid 12 may also enter the arrangement shown in FIG. 1*a* from above or below.

It may be provided that the arrangement shown in FIG. 1*a* continues in repeating fashion to the right and in mirror-symmetrical fashion to the left, such that a first fluid duct 18 runs to the right and a further first fluid duct 18 runs to the left, and thus the first fluid 12 accordingly flows to the right and to the left along the flow paths 16. This arrangement is shown in FIG. 1*c*. In this case, a common inlet 60 for the two first fluid ducts 18 may be provided for the first fluid 12. If the heat exchanger is of cylindrical form, it may be provided that the two first fluid ducts 18 also have a common outlet for the first fluid 12 out of the heat exchange region.

In FIG. 1*a*, the second fluid 14 flows past the first fluid duct 18 from the top in a second fluid duct 36, wherein a second flow part 22 of the second fluid 14 is indicated by arrows. In the side view illustrated, the second fluid duct 36 is arranged behind the first fluid duct 18. The second flow path 22 corresponds to an averaged direction of the flow lines of the second fluid 12. It is self-evident that the flow directions are in the present case merely sketched by way of example.

The first fluid duct 18 has a codirectional-flow duct section 24 and a counterdirectional-flow duct section 26. The codirectional-flow duct section 24 is distinguished by the fact that the flow path 16 of the first fluid 12 runs parallel to the flow path 22 of the second fluid 14. The counterdirectional-flow duct section 26 is distinguished by the fact that the flow path 16 of the first fluid 12 runs oppositely to the flow path 22 of the second fluid 14.

The first fluid duct 18 and the second fluid duct 36 have a common fluid partition 28. A part of the fluid partition 28 is formed by the flow partition 20 or by the multiplicity of flow partitions 20. Heat transport 30 takes place through the fluid partition 28 and the flow partition 20. Those duct sections of the first fluid duct 18 and of the second fluid duct 36 which participate in the heat transport 30 collectively form the heat exchange region of the heat exchanger. It is self-evident that the heat exchange region may also comprise regions which are not fluidically connected to one another.

In the present exemplary embodiment, the first fluid 12 is a liquid coolant. It may also be provided that the first fluid 12 is a liquid, in particular water or a water-glycol mixture. The second fluid 14 is a gas, preferably air or an exhaust gas of an internal combustion engine. The first fluid 12 is at a lower temperature than the second fluid 14. In the present case, the heat transport 30 has the effect that heat is transferred from the first fluid 12 to the second fluid 14. It is self-evident that, in the presence of a reversed temperature ratio between the first and second fluids, heat transport 30 may also take place from the second fluid 14 to the first fluid 12.

It is self-evident that the edges of the flow partitions 20 may not only be of angular form but may preferably be rounded, such that a flow resistance in the first fluid duct 18 can be reduced. A further advantage is that the rounded edges and corners give rise to smaller dead spaces of the flow of the first fluid 12 and of the second fluid 14, wherein improved holistic mixing of the first fluid 12 is attained, in particular in the presence of turbulence.

An exchange of heat 30 between the first fluid 12 and the heat exchanger body 11, which substantially forms a fluid partition 28, is advantageously optimized by virtue of at least one overflow edge 32 being arranged in the first fluid duct 18. The overflow edge 32 imparts swirl to the flow of the first fluid 12. In this way, local turbulence of the first fluid 12 is advantageously realized, such that mixing of cold and warm fluid layers of the first fluid 12 takes place. It is self-evident that the flow in the entire first fluid duct 18 may be turbulent. The overflow edge 32 is arranged in a changeover region 34 between the codirectional-flow duct section 24 and the counterdirectional-flow duct section 26. In the changeover region 34, a flow direction of the first fluid 12 runs perpendicular to the second flow path 22 of the second fluid 14. The codirectional-flow duct section 24 and counterdirectional-flow duct section 26 are fluidically connected to one another via the changeover region 34.

It may be provided that the overflow edge 32 is arranged parallel to the flow direction of the second fluid 14. It may also be provided that the flow edge 32 is arranged perpendicular to the flow direction of the first fluid 12. In this way, a swirl with an axis perpendicular to the flow direction of the first fluid 12 is generated, such that mixing of the layers of the first fluid 12 advantageously takes place over an entire width of the first fluid duct 18. It may however also advantageously be provided that the flow duct 32 is arranged obliquely with respect to the flow direction of the first fluid 12. In this way, the axis of the swirl that is generated can be influenced such that a flow speed is higher toward one side of the first fluid duct 18 than toward the other side of the first fluid duct 18, such that owing to the shear forces generated in the fluid, mixing of the first fluid 12 advantageously takes place perpendicularly with respect to the flow direction. An overflow edge 32 may be arranged in the codirectional-flow duct section 24 and/or in the counterdirectional-flow duct section 26. In the present exemplary embodiment, the overflow edge 32 is embedded into a continuation of the flow partition 20 of the fluid duct 18, wherein FIG. 1*b* shows a swirl 16*a* of the first fluid 12 about the overflow edge 32.

FIG. 1*b* shows that the second fluid duct can be divided into an outer subregion 36*a* and an inner subregion 36*b*, wherein the outer subregion 36*a* is arranged in each case in the flow partitions 20 of the first fluid duct 18, such that an exchange of heat between the two fluids can advantageously take place over a large area. It may be provided that the second fluid 14 has, in the outer region 36*a*, a flow direction which is opposite to that of the second fluid 14 flowing in the inner region 36*b*.

In the present exemplary embodiment, in each case one overflow edge 32 is arranged in a base region 53 and in a top region 51 of the heat exchanger body 11.

FIG. 2*a* shows a sectional view through a cylindrical heat exchanger body 111 and a housing 140 of a second exemplary embodiment, wherein cross sections of the first fluid duct 118 and of the second fluid duct 136 are shown. The housing 140, together with the fluid partition 128, delimits the first fluid duct 118 in the heat exchange region. The first fluid 112 and the second fluid 114 are materially separated from one another by the fluid partition 128, wherein flow partitions 120 project in an outward direction from a substantially cylindrical form of the heat exchanger from the fluid partition 128 and as part of said fluid partition 128. The flow partitions 120 have the cross section of an isosceles trapezoid, though may also be of semicircular or elliptical form. The flow partitions 120 may however also have mixed forms of the stated forms. It may also be provided that the outwardly pointing outer side 120*a* of the flow partitions 120 have a trapezoidal form, whereas the inwardly facing inner side 120*b* is in the form of a semicircle or ellipse. It is self-evident that the outer side 120*a* may also be in the form of an ellipse, and the inner side 120*b* may be of trapezoidal form. The second fluid duct 136 has at least one outer subregion 136*a* which is arranged in one of the flow partitions 120. An inner subregion 136*b* of the second fluid duct 136 is connected merely by way of an intermediate region 128*a* of the fluid partition 128 to the first fluid ducts 118 in the heat exchange region.

In the present case, the exemplary embodiment according to the invention has eight flow partitions 120 which, at uniform intervals around the center, project outward from the substantially cylindrical fluid partition 128. It is however also possible for a greater or smaller number of flow partitions 120 to be provided. Advantageous numbers are multiples of two, in particular of four, because these permit an advantageously uniform exchange of heat. An angle $\alpha$ between two apexes 138 of two adjacent flow partitions 120 is then correspondingly greater or smaller. It is self-evident that the angle $\alpha$ between two flow partitions 120 need not be constant, but may vary along a height of the heat exchanger 110. It may also be provided that an angle $\alpha$ spanned between two flow partitions 120 which delimit a codirectional-flow section 124 has a different magnitude than a further angle $\alpha$ spanned between two flow partitions 120 which delimit a counterdirectional-flow section 126. A counterdirectional-flow region 127 is encompassed by the angle $\alpha$. A codirectional-flow region 125 is delimited accordingly.

The illustration does not show inflows and outflows of the first fluid and of the second fluid. It may be provided that the cross section of the second fluid duct 136 varies over the course of the second flow path of the second fluid 114. It may be provided that the cross section of the second fluid duct 136 narrows in particular in an outflow region. It may however also be provided that the second fluid flows into the second fluid duct 136 in the inner subregion 136*b* and flows out of the second fluid duct 136 in the outer subregion 136*a*. It may however also be provided that the second fluid 114 flows out of the second fluid duct 136 from the inner subregion 136*b* and flows in in the outer subregion 136*a* of the second fluid duct 136. In the latter variants, the second fluid duct 114 turns through 180° in a base region (not illustrated) of the heat exchanger body 111.

FIG. 2*b* shows an alternative angle segment of the second exemplary embodiment illustrated in FIG. 2*a*, wherein the housing 140 is calked to the flow partitions 120 in a support region 142. The housing 140 may also be clamped, welded or adhesively bonded to the flow partitions 120 in the support region 142. The heat exchanger body 111 may however also be merely inserted into the housing 140 without a fixing connection being formed between the housing 140 and the heat exchanger 111. Alternatively or in addition, the housing 140 may be connected to the flow partitions 120 by way of an intermediate layer, composed preferably of a polymer. It may also be provided that, by contrast to the illustration, or in addition, the housing 140 is connected to the fluid partition 128 by webs or other connecting means. In particular, it is also possible for the housing 140 to have the overflow edges 132.

It is preferably provided that the edges 144 of the fluid partition 128, in particular of the flow partitions 120, are rounded. In this way, a rounded form of the fluid partition is realized. In particular, by way of the rounded edges 144, it can be achieved that a wall thickness 146 of the fluid partition 128 is constant over the entire profile. In this way, it is advantageously possible to eliminate material accumulations which impede heat transport and reduce the efficiency of the exchange of heat.

FIG. 3*a* shows a sectional view of a heat exchanger body 211, which is formed as a unipartite cylindrical fluid partition 228 of the two fluids 212, 214, of a third exemplary embodiment of a heat exchanger 210, in the outer region of which a first fluid duct 218 is provided and in the interior of which a second fluid duct 236 is formed. An inlet 260, provided in a housing 240 shown in FIG. 3*c*, for the first fluid 212 serves as an inlet for the first fluid 212 into a chamber 252 which is provided in a base region 250 of the fluid partition 228. The first fluid 212 flows from the chamber 252 in the base region 250 along a section, which is hidden in FIG. 3*a*, of the first fluid duct 218 into a side region, wherein, in the side region of the heat exchanger body 211, there is arranged a multiplicity of counterdirectional-flow regions and codirectional-flow regions arranged in succession, corresponding to the first exemplary embodiment. In this case, an overflow edge 232 is shown, over which the first fluid 212 flows. The flow of the first fluid 212 is indicated by the flow arrows 216 thereof in FIG. 3*a*. It is self-evident that the wall thickness of the heat exchanger body 211 may be constant.

As per FIG. 3*b*, the heat exchanger 210 or the fluid partition 228 has 16 flow partitions 220 which are arranged at uniform intervals around a central axis 254 of the heat exchanger 210. The flow partitions 220, which are in the form of external pockets, form outer subregions 236*a* of the fluid duct 236, wherein surfaces 256, pointing inward toward the central axis 254, of the flow partitions 220 together form an inner subregion 236*b*, in the form of a cylindrical inner duct, of the second fluid duct 236.

The second fluid 214 flows into the second fluid duct 236 from the left in FIG. 3*a*, proceeding from a top region 251, into the cylindrical inner region 236*b* situated centrally around the central axis 254, wherein the flow of the second fluid 214 is indicated in FIG. 3*a* by flow paths 217. In particular, the second fluid duct 236 has a spherical cap-shaped base 256 which is impinged on by the second fluid 214, wherein offshoots of the spherical cap-shaped base 256 extend from the inner region 236*b* into the outer subregions 236*a*, in the present case sixteen outer subregions 236*a*, in the flow partitions 220. The second fluid 214 flows onward from the inner subregion 236*b* to the spherical cap-shaped base 256, is diverted there twice through 90°, through a total of 180°, and flows in the outer subregions 236*a* between two flow partitions 220 back to the top region 251. The spherical cap shape of the base 256 in this case assists the diversion of the second fluid 214 into the outer subregions 236*a*. The second fluid 214 flowing in the outer subregion 236*a* is in this case in heat-exchanging contact with the first fluid 212 in the first fluid duct 218, whereas, between that fraction of the second fluid 214 which is flowing in the outer subregion 236*a* and that fraction of the second fluid 214 which is flowing in the inner subregion 236*b*, an exchange of heat takes place by swirling in a boundary layer of the two partial flows. To prevent said swirling, a preferably thin partition (not shown) may be inserted into the second fluid duct 236.

In the sectional view shown in FIG. 3*b*, for illustrative purposes, the flow paths 217 of the second fluid 214 have been indicated, wherein the fluid flowing from the top region 251 to the base region 250 in the inner subregion 236*b* is indicated by circles with a cross, and wherein the fluid flowing from the base region 250 back to the top region 251 in the outer subregions 236*a* is indicated by circles with a dot. It is self-evident that the flow directions of the two fluids may also be reversed. In this way, it is advantageously possible for the temperature difference between the first fluid 212 and the second fluid 214 to be increased, such that a better exchange of heat can be realized.

FIG. 3*c* shows the housing 240, which is in the form of a cylinder, of the heat exchanger 210, said housing being arranged around the heat exchanger body 211 in an assembled state. A shell surface 264 of the housing 240 bears against or is clamped to support regions 242 of the heat exchanger body 211, such that the first fluid duct 218 is formed between the fluid partition 228 and the housing 240. It may also be provided that the housing 240 is clamped in fluid-tight fashion to the heat exchanger body 211. The housing 240 has an inlet 260 and an outlet 262 in the base region 250 of the heat exchanger 210. The first fluid 212 is admitted into the first fluid duct 218 through the inlet 260, and flows there initially into the chamber 252. The first fluid 212 subsequently flows through the codirectional-flow regions 225, counterdirectional-flow regions 227 and changeover regions 234 to the outlet 262. It may be provided that the chamber 252 has multiple outlets to the side regions for the first fluid 212. It may also be provided that one or more inlets is or are provided in the side regions such that the first fluid 212 can be admitted directly into the first fluid duct 212 in the side region. If multiple inlets 260 are provided and a multiplicity of first fluid ducts 218 are provided, first fluid 212 can be admitted into multiple first fluid ducts 218 simultaneously.

LIST OF REFERENCE SIGNS

10, 110, 210 Heat exchanger
11, 111, 211 Heat exchanger body
12, 112, 212 First fluid
14, 114, 214 Second fluid
16, 216 First flow path
16*a* Swirl
217 Second flow path
18, 118, 218 First fluid duct
20, 120, 220 Flow partition
20*a*, 120*a*, 220*a* Outer side of the flow partition
20*b*, 120*b*, 220*b* Inner side of the flow partition
22, 122, 222 Second flow path
24, 124 Codirectional-flow duct section
25, 125, 225 Codirectional-flow region

26, 126 Counterdirectional-flow duct section
27, 127 Counterdirectional-flow region
28, 128, 228 Fluid partition
28*a* Intermediate region
30, 130, 230 Heat transport
32, 132, 232 Overflow edge
34, 134, 234 Changeover region
36, 136, 236 Second fluid duct
36*a*, 136*a*, 236*a* Outer subregion of the second fluid duct
36*b*, 136*b*, 236*b* Inner subregion of the second fluid duct
38, 138 Apex
140, 240 Housing
142, 242 Support region
144 Edges of the fluid partition
146 Wall thickness
250 Base region
251 Top region
252 Chamber
254 Central axis
256 Base
258 Outer wall
260 Inlet
262 Outlet
264 Shell surface

The invention claimed is:

1. A heat exchanger for motor vehicles, said heat exchanger comprising:

a heat exchanger body;

a first fluid duct through which a first fluid can flow;

a second fluid duct through which a second fluid can flow, wherein one of the first fluid and the second fluid is a relatively warm fluid and warmer than the other of the first fluid and the second fluid, which is a relatively cool fluid, wherein, during use of the heat exchanger with the first fluid and the second fluid, after said fluids enter a heat exchange region, heat transport from the relatively warm fluid to the relatively cool fluid takes place in the heat exchange region, wherein the first fluid duct and the second fluid duct have, in the heat exchange region, at least two common codirectional-flow regions, each consisting of a part of the first fluid duct and a part of the second fluid duct that are adjacent to each other, and one common counterdirectional-flow region, consisting of a part of the first fluid duct and a part of the second fluid duct that are adjacent to each other, arranged between the codirectional-flow regions, or at least two common counterdirectional-flow regions, each consisting of a part of the first fluid duct and a part of the second fluid duct that are adjacent to each other, and one common codirectional-flow region, consisting of a part of the first fluid duct and a part of the second fluid duct that are adjacent to each other, arranged between the counterdirectional-flow regions, wherein the first fluid duct has at least one of a codirectional-flow duct section or a counterdirectional-flow duct section and at least two of the other of a codirectional-flow duct section or a counterdirectional-flow duct section, wherein the codirectional-and the counterdirectional-flow duct sections are fluidically connected, and wherein a fluid partition wall arranged between the first fluid duct and the second fluid duct forms a flow partition between each adjacent codirectional-flow duct section and counterdirectional-flow duct section.

2. The heat exchanger as claimed in claim 1, wherein a first of the at least two codirectional-flow regions, the counterdirectional-flow region and a second of the at least two codirectional-flow regions are fluidically connected in the stated sequence, such that the first fluid can flow through said regions in series.

3. The heat exchanger as claimed in claim 1, wherein a first of the at least two counterdirectional-flow regions, the codirectional-flow region and a second of the two counterdirectional-flow regions are fluidically connected in the stated sequence, such that the first fluid can flow through said regions in succession.

4. The heat exchanger as claimed in claim 1, wherein the counterdirectional-flow regions and the codirectional-flow regions extend between a base region and a top region.

5. The heat exchanger as claimed in claim 4, wherein at least one changeover region between a counterdirectional-flow region and a codirectional-flow region are arranged in the base region and/or in the top region.

6. The heat exchanger as claimed in claim 4, wherein an inlet and an outlet for the first fluid are arranged together in the base region or in the top region.

7. The heat exchanger as claimed in claim 4, wherein an inlet and an outlet for the second fluid are arranged together in the base region or in the top region.

8. The heat exchanger as claimed in claim 1, wherein the second fluid duct is arranged at least partially in the flow partition.

9. The heat exchanger as claimed in claim 1, wherein fluid partition wall has a cylindrical basic shape.

10. The heat exchanger as claimed in claim 9, wherein the flow partition is an outwardly pointing part of the fluid partition.

11. The heat exchanger as claimed in claim 1, wherein the heat exchanger body, in particular the fluid partition, has a constant wall thickness, in particular a constant wall thickness in the heat exchange region.

12. The heat exchanger as claimed in claim 1, wherein overflow edges are arranged in the first fluid duct such that swirl is imparted to the first fluid.

13. The heat exchanger as claimed in claim 12, wherein the overflow edges are arranged in a changeover region between the codirectional-flow region and the counterdirectional-flow region, such that swirl is imparted to the first fluid in the changeover region.

14. A heat exchanger for motor vehicles, said heat exchanger comprising:

a heat exchanger body;

a first fluid duct through which a first fluid can flow;

a second fluid duct through which a second fluid can flow, wherein the first and second fluid ducts are oriented longitudinally between a top region and a base region, and one of the first fluid and the second fluid is a relatively warm fluid and warmer than the other of the first fluid and the second fluid, which is a relatively cool fluid, wherein, during use of the heat exchanger with the first fluid and the second fluid, after said fluids enter a heat exchange region, heat transport from the relatively warm fluid to the relatively cool fluid takes place in the heat exchange region, wherein the first fluid duct and the second fluid duct have, in the heat exchange region, at least two common codirectional-flow regions, each consisting of a part of the first fluid duct and a part of the second fluid duct that are adjacent to each other, and one common counterdirectional-flow region, consisting of a part of the first fluid duct and a part of the second fluid duct that are adjacent to each other, arranged between the codirectional-flow regions, or at least two common counterdirectional-flow regions, each consisting of a part of the first fluid duct and a part of the second fluid duct that are adjacent to each other, and one common codirectional-flow region, consisting of a part of the first fluid duct and a part of the second fluid duct that are adjacent to each other, arranged between the counterdirectional-flow regions, wherein the first fluid duct has at least one of a codirectional-flow duct section or a counterdirectional-flow duct section and at least two of the other of a codirectional-flow duct section or a counterdirectional-flow duct section, wherein the codirectional-and the counterdirectional-flow duct sections are fluidically connected, and wherein a fluid partition wall arranged between the first fluid duct and the second fluid duct forms a flow partition between each adjacent codirectional-flow duct section and counterdirectional-flow duct section.

* * * * *